United States Patent [19]

Murphy et al.

[11] Patent Number: 4,735,189

[45] Date of Patent: Apr. 5, 1988

[54] PORTABLE ASH AUGER

[76] Inventors: Douglas S. Murphy, P.O. Box 304, Pleasant View, Colo. 81331; Roger D. Alink, Box 589; James R. Lewis, Box 742, both of Sandia Park, N. Mex. 87047

[21] Appl. No.: 886,924

[22] Filed: Jul. 18, 1986

[51] Int. Cl.[4] ..... F23J 1/00

[52] U.S. Cl. ..... 126/242; 126/243; 110/165 R; 110/166; 294/9; 294/55

[58] Field of Search ..... 126/242, 243; 110/165 R, 166; 294/9, 55

[56] References Cited

U.S. PATENT DOCUMENTS

| | | | |
|---|---|---|---|
| 1,971,716 | 8/1934 | Hitchcock | 126/242 X |
| 2,100,937 | 11/1937 | Bowe | 126/242 X |
| 4,457,548 | 7/1984 | Robins et al. | 294/9 |
| 4,536,023 | 8/1985 | Sutter | 126/242 X |

*Primary Examiner*—Edward G. Favors

*Attorney, Agent, or Firm*—B. Deon Criddle

[57] ABSTRACT

A portable ash auger including a heat and fire resistant housing with an attached handle and with a fireproof tube that opens into and projects from the housing while surrounding an auger having a tip end extending beyond the tube and drive means for the auger.

2 Claims, 1 Drawing Sheet

PORTABLE ASH AUGER

BACKGROUND OF THE INVENTION

1. Field of the Invention

The present invention relates to the field of ash removal and receiving devices.

2. Prior Art

There are many known devices used to remove ashes from a furnace, either while the furnace is being used or when it is cold. Generally speaking, the ash removal devices are either fixed or portable. Fixed devices include those that employ an auger device built into the furnace structure to transport the ashes from inside a furnace to outside the furnace. U.S. Pat. Nos. 426,038 (Miles); 1,039,352 (Bernotowicz); Re: 18,006 (Hall); 2,121,229 (Halter); 2,248,206 (Suman); 2,558,626 (Pfau); and 2,637,285 (Getz), for example, show such structures. The devices shown in these patents are permanently mounted with respect to furnaces and generally the ashes of the furnace simply fall into the auger and are transported out of the furnace by rotation of the auger in conjunction with a stationary auger housing. Various drive means are used to rotate the auger. The churning of the auger flights may cause loose dust within the firebox that may interfere with proper burning of the fire. Such resulting dust may be passed out the furnace stack to create enviornmental problems in the surrounding area. With these fixed auger structures, the firebox of the furnace must have a special configuration to divert the ash onto the auger.

Previously known portable ash removing devices have utilized a wide variety of pails, scoops, shovels and pans, none of which are entirely suitable in handling the dust developed during use of the devices. Also, they are generally quite slow to use and require multiple operations on the part of the user. In using these devices it is often possible to drop the hot cinders being collected. See U.S. Pats. Nos. 33,058 (Walker); 767,648 (Korjibsky); 1,767,312 (Russell); 4,411,253 (Devin); 4,416,252 (Blank, Jr.); 4,305,376; and 4,497,308 (Johnson).

It has been found that a hand held ash auger such as that disclosed in the present invention is preferable for many uses and that it is readily adapted to use with all types of furnaces and heaters while being particularly useful with the usual open, built-in fireplaces, free-standing fireplaces and fireplace inserts used to achieve more efficient room and house heating.

OBJECTS OF THE INVENTION

A principal object of the present invention is to provide a portable ash removal and collection system usable with all types of solid fuel burning furnaces, fireplaces and stoves.

Another object of the present invention is to provide an ash removal system that is easy to use and that will efficiently collect and return ash, without leaving dust residue and without adversely affecting the burning of a fire in the furnace, fireplace or heater.

Still another object of the present invention is to provide a portable ash removal system that is safe to use, even by relatively untrained persons.

Another object of the present invention is to provide an ash auger that is inexpensive to manufacture and easy to maintain.

FEATURES OF THE INVENTION

Principal features of the present invention include a heat and fire resistant housing forming an ash chamber, with an attached handle and with a tube opening into and projecting from the housing forming the chamber. The free end of the auger is angled to form a scoop and to reach into firebox corners. The auger, mounted to turn in the tube has a flight thereon that extends from the free end of the tube to proximate the chamber. An auger shaft on which the flight is turned extends through the housing and out a side opposite the tube. The auger shaft is journaled in the tube and at the point where it passes through the housing. The attached handle means on the housing allows for convenient operation of the auger. The handle on the main body permits the user to direct the auger into different locations in a firebox. Because ash can only enter at the end of the tube, a minimum amount of disturbance is generated and accordingly, the amount of dust generated during use of the device is maintained at a minimum.

The angled cut in the end of the auger tube exposes only a small portion of the auger, which portion contacts the ashes and when the auger is turning, directs them into the tube. The tube provides a full enclosure to minimize dust problems.

Other objects and features of the invention will become apparent from the following detailed description and drawing, disclosing what are presently contemplated as being the best modes of the invention.

THE DRAWING

In the drawings:

FIG. 1 is a side-elevation view of a first hand cranked embodiment of the ash auger of the invention with a portion broken away to show the mounting of the auger shaft;

FIG. 2, a top plan view of the invention, with portions broken away to show the auger and the interior of the housing; and FIG. 3, a side-elevation view, partially cut-away to show the motor.

DETAILED DESCRIPTION

Figure 1:
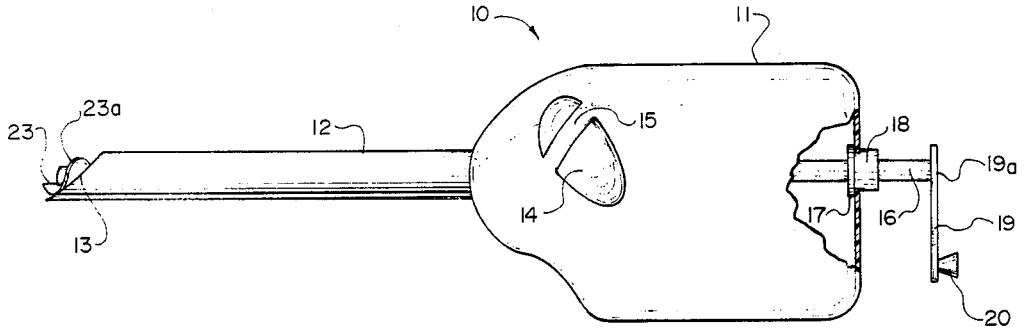
Figure 2:
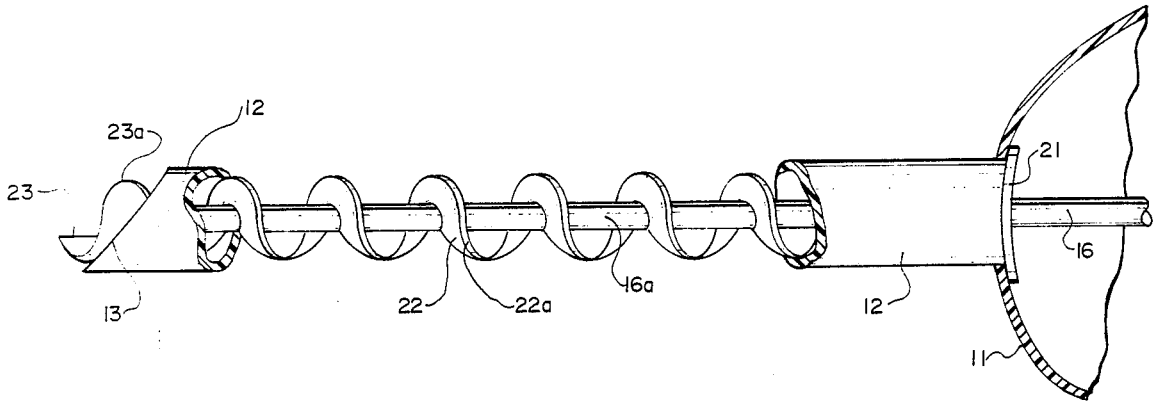

Referring now to the drawing:

In the illustrated embodiment of FIGS. 1 and 2, the ash auger of the invention is shown generally at 10. The ash auger includes an ash chamber 11 formed in a housing 12 that is preferably made of heat and fire resistant material such as suitably formulated, heat resistant molded plastic. A fireproof tube 13 with a diagonal cut at a free end thereof, has its other end extending through the wall of housing 12 and opens into the ash chamber 11. The housing 12 is preferably molded to provide an integral handle 14 that bridges a recess 15, formed in one side of housing 12. The side mounting of handle 14 allows the unit to be supported with one hand while the auger is operated by the other hand, either by turning of a crank handle or by operation of a control switch, as will be further described.

An auger shaft 16 is rotatably mounted to extend through a rear of the housing 12 and through a bearing 17 and/or bushing 18 mounted in the housing. A crank handle 19 is mounted on the projecting end of shaft 16. Handle 19 may be welded to the shaft or may be attached with other conventional means such as bolts (not shown), threaded into the end of the shaft. Knob 20 is rotatably mounted on handle 19 with bolts (not shown).

In FIG. 2, the shaft 16 is shown journaled through a bearing 21 mounted in the wall of the housing 12. An auger 22 is comprised of a helical flight 23 secured to a portion of the auger shaft 16.

The auger shaft and flight 23, extend to the end of a angled opening in the free end of tube 13. Thus, a tip end 24 of the auger is exposed.

The ash auger of FIGS. 1 and 2 is operated by the user grasping handle 14 in one hand, placing the free end of the tube and the exposed tip end 24 of the auger into ashes in a firebox and turning the handle 19 in the clockwise direction (viewed from the handle end) with the other hand. This rotates the auger in a direction such that the flight engages the ashes and moves them along shaft 16 and through tube 13 into the ash chamber 11. The angled end of tube 13 will serve as a scoop as the end is moved through ashes to direct the ashes into the auger flight 23.

The clearance between the wall of tube 13 and the outer edges of flight 23*a* is made small so that the ashes are efficiently transported and dust from inside the tube cannot escape to atmosphere. The ash chamber 11 is fully enclosed and accordingly, displaced air must exit around auger 22. During rotation of the auger to colect ash only a small volume of dust escapes into the atmosphere since the free end of the tube is positioned in ashes in the firebox.

A heat insulating plate 25 may be provided to cover a portion of the housing 12 around and beneath handle 14. The plate 25, which may be made of any suitable material that will prevent heat transfer therethrough provides a shield to protect the user's hand as handle 14 is grasped.

Housing 12 is curved in all directions away from tube 13 and the ash chamber 11 is large enough to hold the ashes from several days use of a fire bed. Thus, the ashes are discharged from the housing by merely tipping the tube 13 downwardly so that the ashes in the housing will fall to the tube and then turning the auger counterclockwise to discharge the ashes from the free end of the tube.

Figure 3:
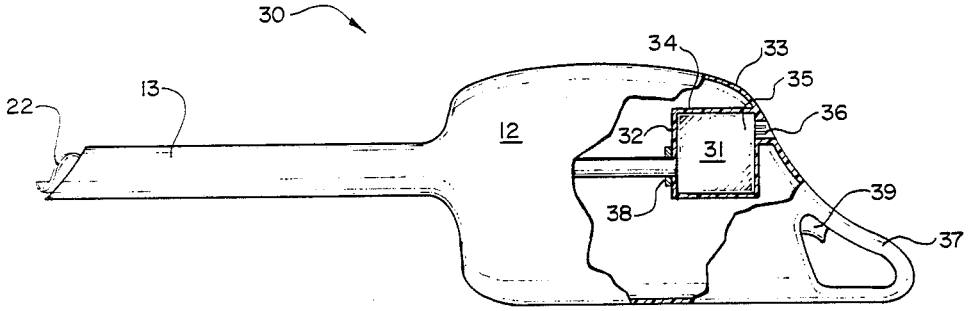

In the embodiment of the invention shown in FIG. 3, the ash auger, shown generally at 30, includes a housing 12 (like numerals being used to identify like components in the different embodiments), and an auger tube 13 having an auger 22 therein.

A reversible electric motor 31 is positioned in a compartment formed in housing 12 by a wall 32. An access panel 33 may be snapped to a portion of the wall of housing 14 to provide access to the compartment and the motor. Vent openings 34 through the access panel provide cooling for the motor and for a rechargeable battery unit 35 also positioned in the compartment. A plug 36 for the rechargeable battery is also mounted in the wall of housing 12.

Another handle 37 (additional to handle 14) is formed at the rear of housing 12 and a pivoting trigger switch 38 is adapted to be operated by a user grasping handle 37 to operate the reversible motor in either a forward or reverse direction. The auger shaft 16 is journaled through bearings 38 in the wall 32 and is coupled at 39 to the output shaft of motor 31.

In using the ash auger of FIG. 3, a user grasps handle 14 in one hand and handle 37 in the other. The tip end of tube 13 is positioned in the ashes of a firebox and the motor switch 39 is operated to turn the auger to move the ashes into the housing. In discharging the ashes the switch 39 is operated to reverse motor 31 and operation of the shaft and the housing is held tip down so that the ashes will move from the housing onto the auger for discharge.

Although a preferred form of our invention has been herein disclosed, it is to be understood that the present disclosure is by way of example and that variations are possible without departing from the subject matter coming within the scope of the following claims, which subject matter we regard as our invention.

We claim:

1. A portable ash auger comprising a housing of heat and fire resistant material and having an ash chamber therein;

a tube having one end terminating at and opening into the ash chamber and projecting from the housing, said tube being of non-combustible material, and the other end of the tube having an opening extending angularly across the axis of the tube, whereby one side of the tube extends further from the housing than an opposite side;

an auger including a central shaft and an auger flight turned around a portion of the shaft, said portion extending from the outermost portion of the tube to proximate the housing and the shaft further extending through the ash chamber and the housing; and drive means fixed to the shaft at the side of the housing opposite the ash chamber said drive means comprising a reversible electric motor, a compartment in the housing receiving the motor, and means coupling output shaft of the motor to the auger.

2. A portable ash auger as in claim 1, further including a rechargeable battery; and means connecting the battery to drive the motor.

* * * * *